United States Patent [19]

Klein et al.

[11] 4,127,511

[45] Nov. 28, 1978

[54] CERAMIC ELECTRICAL RESISTOR WITH NONLINEAR VOLTAGE CHARACTERISTIC

[75] Inventors: Hans P. Klein; Anton Menth, both of Nussbaumen, Switzerland

[73] Assignee: BBC Brown, Boveri & Company, Limited, Baden, Switzerland

[21] Appl. No.: 811,986

[22] Filed: Jun. 30, 1977

[30] Foreign Application Priority Data

Jul. 1, 1976 [CH] Switzerland ..... 8424/76

[51] Int. Cl.[2] ..... H01B 1/08

[52] U.S. Cl. ..... 252/518; 252/519; 106/73.5

[58] Field of Search ..... 252/518, 519; 106/73.5; 338/20

[56] References Cited

U.S. PATENT DOCUMENTS

| | | | |
|---|---|---|---|
| 3,764,566 | 10/1973 | Matsuoka et al. | 252/518 |
| 3,925,261 | 12/1975 | Lauterbach-Dammler | 252/519 |
| 3,928,245 | 12/1975 | Fishman et al. | 252/519 X |
| 3,959,543 | 5/1976 | Ellis | 252/518 X |

*Primary Examiner*—Benjamin R. Padgett
*Assistant Examiner*—E. Suzanne Parr
*Attorney, Agent, or Firm*—Oblon, Fisher, Spivak, McClelland & Maier

[57] ABSTRACT

A ceramic electrical resistor with nonlinear current-voltage characteristic has a base of zinc oxide and at least one other component. A method is provided for producing such resistors.

7 Claims, 2 Drawing Figures

I* [A]
10^1
10^0
10^-1
10^-2
10^-3
10^-4
10^-5
10^-6
0
200
400
600
800
1000
U* [V]

CERAMIC ELECTRICAL RESISTOR WITH NONLINEAR VOLTAGE CHARACTERISTIC

BACKGROUND OF THE INVENTION

1. Field of the Invention

The invention relates to a ceramic electrical resistor with a nonlinear current-voltage characteristic having a base of zinc oxide and at least one other component.

The invention further is concerned with a method for producing such ceramic electrical resistors.

2. Description of the Prior Art

Electrical resistor materials with nonlinear current-voltage characteristics in the form of sintered ceramic masses are known in numerous compositional varieties. A main group of these materials has a zinc oxide base, to which other metal oxides are added for the formation of insulating grain boundary intermediate layers. The current-voltage characteristic of such nonlinear resistors in the range of interest is ordinarily described by the following equation:

$$I = \left(\frac{U}{C \cdot d}\right)^{\alpha}$$

I = current in mA flowing through a $1cm^2$ cross section

U = voltage in V across the resistor

C = "nonlinear resistance" measured in V/mm in the direction of potential drop for a current of 1 $mA/cm^2$ d = thickness in mm of the resistor in the direction of potential drop $\alpha$ = nonlinear (voltage −) exponent.

Customarily, $\alpha$ is defined for one or more current ranges of interest, e.g.:

$\alpha_1$ for 0.1 to 1 $mA/cm^2$ $\alpha_2$ for 1 to 10 $mA/cm^2$.

By choice of the composition of the additives enveloping the zinc oxide base, the characteristic parameters C and $\alpha$ can be varied within wide limits and matched to the particular application of the resistor. In order to obtain a sufficiently large $\alpha$ it was thought necessary in the prior art that the mixtures contain at least one of the two oxides PbO and $Bi_2O_3$ and still other additives for their stabilization. Such resistor materials and method of producing them are described in numerous publications (e.g. Michio Matsuoka, "Nonohmic Properties of Zinc Oxide Ceramics," *Jap. Jour. Applied Physics,* Vol. 10, No. 6 (June 1971); DT-OS No. 24 50 108; DT-AS No. 23 10 437; DT-OS No. 23 69 232).

Most zinc oxide base nonlinear resistors have bismuth oxide as the essential additive. This is connected with the favorable effect of this component, so that there is a widespread expert prejudice to the effect that no resistor with a high nonlinear exponent $\alpha$ can be produced without $Bi_2O_3$.

In practice, however, adherence to a fixed composition of the material leads to serious difficulties and the analysis of the end product can differ greatly from that of the initial mixture. This is connected with the great volatility of $Bi_2O_3$, which at the customary sintering temperature of over 1100° C. already has so high a vapor pressure that a significant portion of it evaporates during the sintering process, which leads to uncontrollable and hard-to-duplicate results in the final composition of the sintered material. The evaporation rate depends on the temperature, the time, the oven volume and the temperature gradient in the oven, and can be determined and maintained constant only with great difficulty.

Nonlinear resistor parts with a ZnO + $Bi_2O_3$ base and containing other additives exhibit an unsatisfactory electrical stability. Their current-voltage characteristic changes during electrical loading. Such loading can consist of, for example, a d.c. current load of 1 $mA/cm^2$ current density at 70° C. ambient temperature, acting for over 500 hr. Another possible harmful type of load is, for example, a succession of two current pulses of the first standard curve shape 8/20 (interval in $\mu$sec) of "IEC Publication 99-1, 1958/1970 Edition" or "VDE 0675, Guidelines for Overvoltage Protection Devices, Part 1: Valve-type Arresters for A.C. Lines of May 1972" with a maximum current density of $1000A/cm^2$. Such loads alter the characteristic unfavorably in that the nonlinear resistance (C) and the nonlinear exponent ($\alpha$) decrease, whereby the component involved has a reduced functional capability. It is to be noted that the characteristic becomes current-direction dependent, i.e., asymmetric; and it is no longer identical in the forward and reverse directions. This makes the component unusable for many practical applications.

From the processing point of view the desire is for the greatest possible simplification and effective control of the production process. Because of the high volatility of the additives used heretofore, the end product is dependent in its properties to a high degree on hard-to-control production parameters, whereby in particular the reproducibility of the results suffers.

SUMMARY OF THE INVENTION

Accordingly, one object of the present invention is to provide ceramic electrical resistors with a nonlinear current-dependent current-voltage characteristic and a high nonlinear exponent.

Another object of the invention is to provide ceramic electrical resistors with high stability and reproducible properties.

Yet another object of the invention is to provide a method of producing ceramic electrical resistors, which method permits simplification and effective control of the production process, avoids the use of highly volatile ingredients, and leads to a stable product with reproducible properties.

Briefly, these and other objects of the present invention can be attained by providing ceramic electrical resistors which have a composition comprising a base of zinc oxide, an oxide of boron, and at least one additional metal oxide, and which contain essentially no bismuth oxide; and by providing a method for the production of such resistors.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
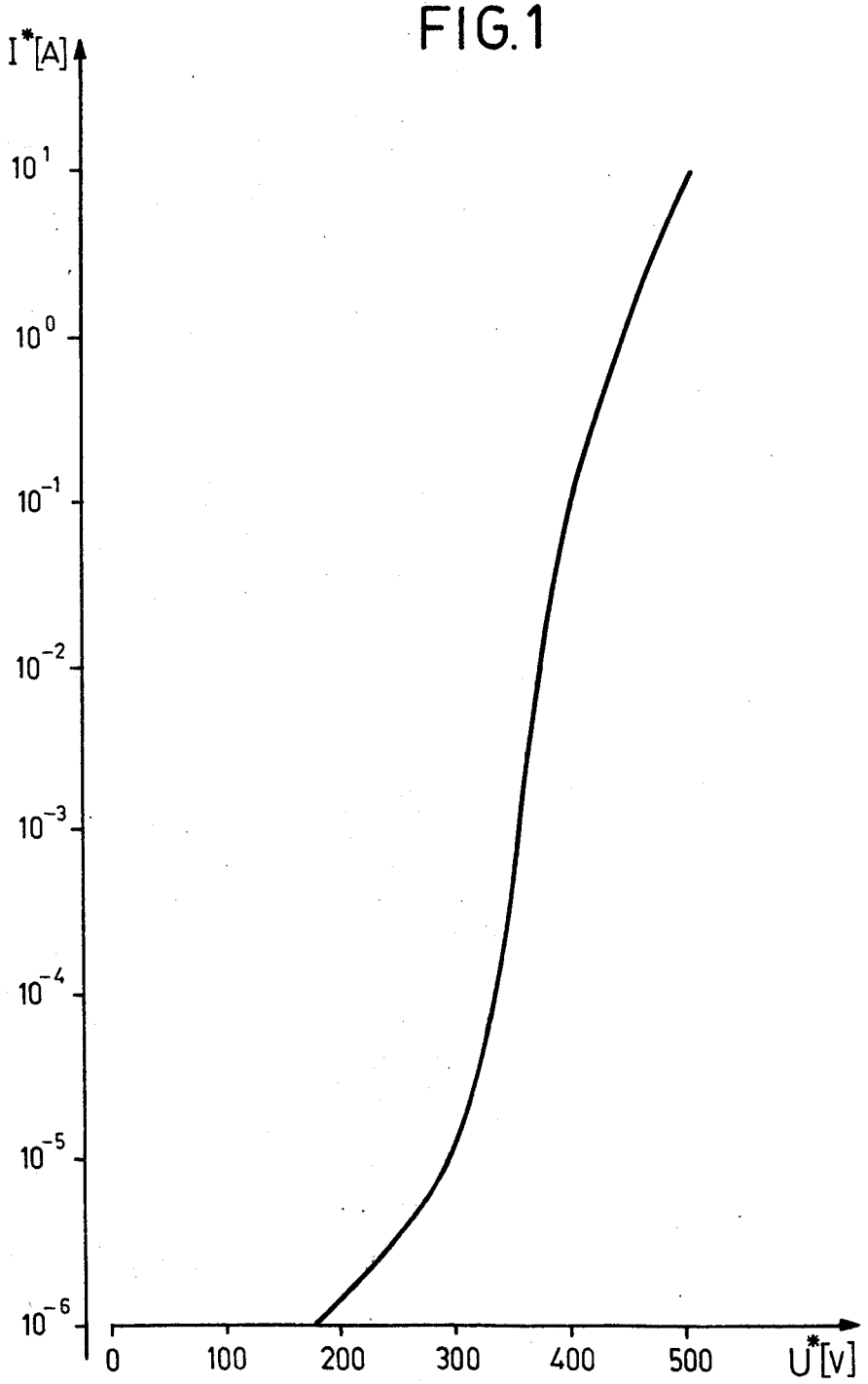
FIG. 1 is the current-voltage characteristic, $I^* = f(U^*)$, for a sintered ceramic material having the composition of Example 1.

The ceramic electrical resistors of the invention have a composition comprising a base of zinc oxide, an oxide of boron, and at least one additional oxide selected from the group consisting of the oxides of cobalt, manganese, chromium, antimony, silicon, and mixtures thereof. No bismuth oxide is used in preparing the composition.

The zinc oxide base is present in an amount of from 50 to 99.9 mol.%, and preferably from 90 to 98 mol.%.

The preferred oxide of boron is boron trioxide, $B_2O_3$, which is advantageously present in an amount of from 0.05 to 10 mol.%, and preferably from 0.5 to 3 mol.%.

Suitable additional oxides may be added such as CoO, $MnO_2$, $Sb_2O_3$, $Cr_2O_3$, $SiO_2$. These additional oxides are advantageously present in an amount of from 0.01 to 5 mol.%, and preferably from 0.01 to 3 mol.%.

Admixtures of these additional oxides may be used such as 0.5 to 3 mol.% CoO and 0.5 to 3 mol.% $MnO_2$; 1 to 3 mol.% CoO, 1 to 3 mol.% $MnO_2$, 1 to 3 mol.% $Sb_2O_3$ and 0.01 to 1 mol.% $Cr_2O_3$; and 0.5 to 3 mol.% CoO, 0.5 to 3 mol.% $MnO_2$ and 0.5 to 3 mol.% $SiO_2$.

In accordance with the invention, the ceramic electrical resistors are produced by mixing, drying, sifting, calcining and pressing the powdered raw materials of 0.1 to 1$\mu$ grain size and subjecting the resultant briquette to a heat treatment.

In a typical process, the appropriate metal oxides are mixed with a suitable vehicle, such as ethanol, and the paste is ground in a ball mill to produce a powder with an average grain diameter of from about 0.1$\mu$ to 1$\mu$.

The powder is evaporatively dried and sifted through a sieve, preferably of about 0.5 mm mesh size.

The sifted powder is then calcined or annealed in air, preferably at about 450° C. for a period of time of from 1 to 3 hours, preferably about 3 hours.

The calcined powder is made into tablets in a tablet press, preferably using about a one-gram portion for each tablet, and preferably producing tablets of about 13 mm diameter. The pressing is carried out at pressures of from 300 to 500 kp/cm$^2$, preferably 500 kp/cm$^2$.

The tablets are sintered to produce a sintered briquette. Sintering is advantageously performed at a temperature of from 1100° to 1350° C. in air for about 1 hour, and preferably at from 1200° to 1250° C.

For some compositions, the $\alpha$ exponent can be further raised if the sintered briquette is subjected to a further annealing treatment, which advantageously comprises annealing the sintered briquette for about 15 hours at a temperature of from 600° to 1000° C. under a pressure of about 760 torr., in an oxygen atmosphere. A preferred temperature range for this annealing is from 800° to 850° C.

After heat treatment, the briquette is ground plane parallel on its two faces and provided with contacts. Suitable methods for applying contacts include baking, vapor deposition, sputtering, or metal spraying.

The ceramic electrical resistors of the invention exhibit a high electrical stability in comparison with known substances and show, after current loading, comparatively slight asymmetry of the current-voltage characteristic in the forward and reverse directions. The materials of the invention are distinguished by great constancy of their chemical composition and consequently uniform characteristic properties.

By the production method of the invention highly volatile components in the sinter-masses are avoided, so that the composition of the end product can easily be adjusted by weighing the starting materials and is independent of the sintering conditions. Thus, closely reproducible properties are achievable in different batches of the same resistor type, which is of decisive importance for practical use as an electrical circuit component.

Having generally described the invention, a more complete understanding can be obtained by reference to certain specific examples, which are included for purposes of illustration only and are not intended to be limiting unless otherwise specified.

EXAMPLE 1

In an agate beaker of 250 ml capacity 20g of a powder of the composition

| | | |
|---|---|---|
| ZnO | 96.95 | mol % |
| $B_2O_3$ | 1 | mol % |
| CoO | 1 | mol % |
| $MnO_2$ | 1 | mol % |

were mixed with 150 ml of technical grade ethyl alcohol. The paste was ground with 5 agate balls of 10 mm diameter for 1 hr. in a ball mill (Pulverisetta type laboratory crusher). The average grain diameter in the resulting material ranges from 0.1$\mu$ to 1$\mu$. Next the powder was dried by evaporation of the ethyl alcohol. Then the powder was sifted through a sieve of 0.5 mm mesh size and calcined for 3 hr. at 450° C. in air. Each 1g of powder was made into a 13 mm diameter tablet in a simple laboratory press at a pressure of 500 kp/cm$^2$. The briquettes were placed on a platinum foil, covered with an alumina crucible of 40 mm diameter and 40 mm height and put into a cold oven. The oven was then heated rapidly to the sintering temperature of 1250° C. and turned off after a sintering duration of 1 hr. at 1250° C. The samples were left in the oven so that they cooled at an average rate of 300° C./hr. to a temperature of 300° C. The entire sintering process was carried out in air.

A tablet sintered in this manner presents a diameter of 10 mm and a thickness of 2.5 mm. The tablet was ground plane parallel on its two sides with abrasive paper of coarseness 400. Cross-shaped silver foil contacts were applied to the two sides, their outside edges approaching no closer than 1 mm to the rim of the tablet.

Electrical testing with a d.c. voltage gave the following values of the nonlinearity:

$$\alpha_1 = \alpha 0.1 \div 1\text{mA/cm}^2 = 19$$

$$\alpha_2 = \alpha_1 \div 10\text{ mA/cm}^2 = 34$$

$$C = 149\text{ V/mm}$$

The current-voltage characteristic is shown in FIG. 1. The voltage scale is linear while the current scale is logarithmic.

EXAMPLE 2

A tablet was made as a sintered mass from the same raw materials and by the same method as in Example 1. Immediately after the sintering the tablet was subjected to a heat treatment in the form of an annealing for 15 hrs. at a temperature of 830° C. under an oxygen pressure of 760 torr. In this way the nonlinear exponent $\alpha$ was significantly improved. After the tablet was ground and provided with contacts by the method described in Example 1, the following electrical values were obtained.

$$\alpha_1 = \alpha_{0.1} \div 1\text{mA/cm}^2 = 44$$

$$\alpha_2 = \alpha_1 \div 10\text{mA/cm}^2 = 45$$

$$C = 154 \text{ V/mm}$$

EXAMPLE 3

Following the procedure given in Example 1, 20g of a powder with the composition

| | | |
|---|---|---|
| ZnO | 92.95 | mol % |
| $B_2O_3$ | 2 | mol % |
| CoO | 2 | mol % |
| $MnO_2$ | 2 | mol % |
| $Sb_2O_3$ | 1 | mol % |
| $Cr_2O_3$ | 0.05 | mol % |

were mixed with ethyl alcohol, dried, calcined, pressed and sintered. A very good $\alpha$ as well as a high C was obtained with this material. The electrical measurements on finished sintered samples gave the following values:

$$\alpha_1 = \alpha_{0.1} \div 1\text{mA/cm}^2 = 56$$

$$\alpha_2 = \alpha_1 \div 10\text{mA/cm}^2 = 58$$

$$C = 221 \text{ V/mm.}$$

Figure 2:
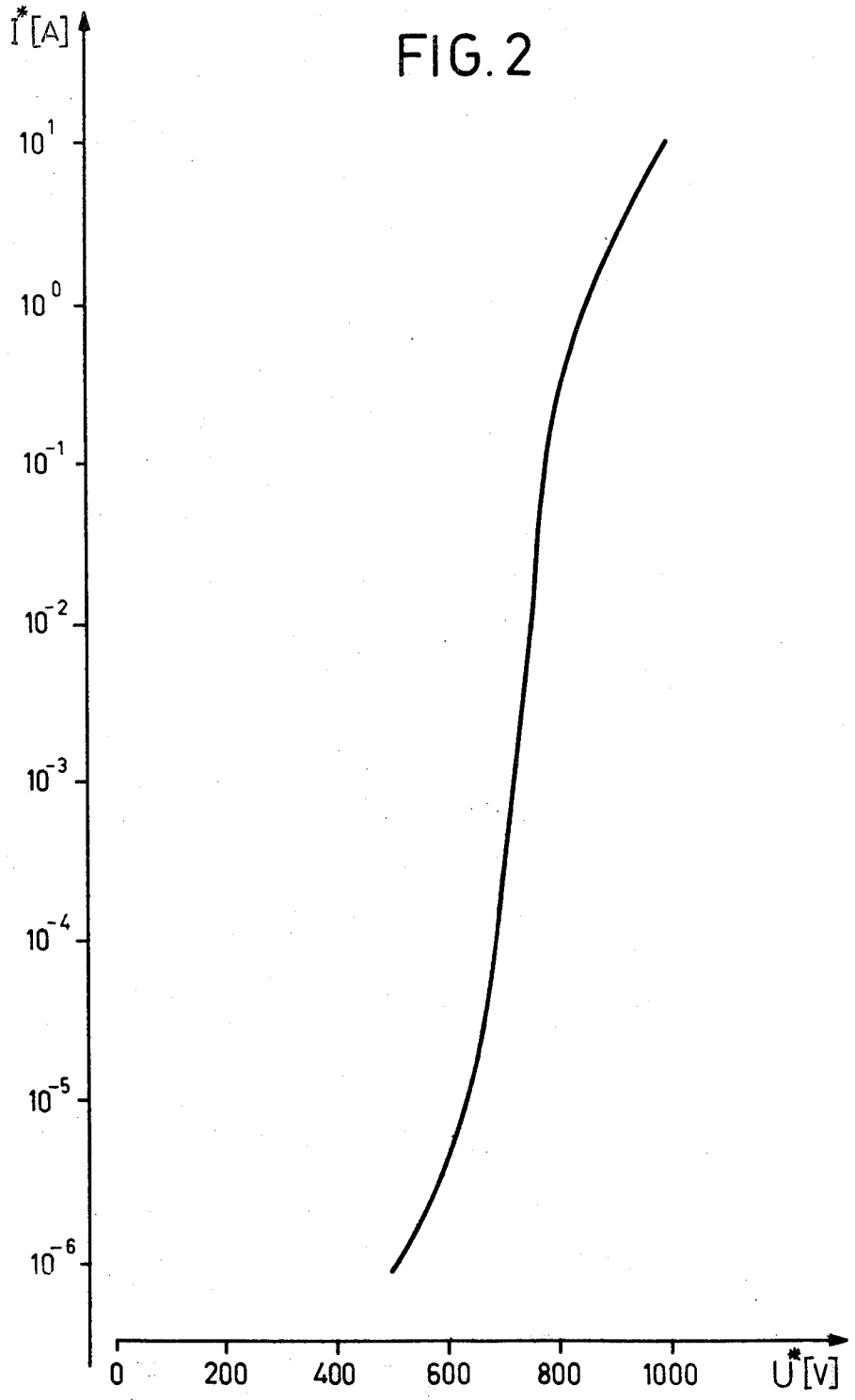
FIG. 2 is the current voltage characteristic, $I^* = f(U^*)$ for a sintered ceramic material having the composition of Example 3.

The current voltage characteristic is shown in FIG. 2. The voltage scale is linear while the current scale is logarithmic.

EXAMPLE 4

By the method of Example 1, 20g of a powder of composition

| | | |
|---|---|---|
| ZnO | 96 | mol % |
| $B_2O_3$ | 1 | mol % |

-continued

| | | |
|---|---|---|
| CoO | 1 | mol % |
| $MnO_2$ | 1 | mol % |
| $SiO_2$ | 1 | mol % |

were mixed with ethyl alcohol, dried, pressed and sintered. The electrical measurements on the sintered tablets gave the following values:

$$\alpha_1 = \alpha_{0.1} \div 1\text{mA/cm}^2 = 42$$

$$\alpha_2 = \alpha_1 \div 10\text{mA/cm}^2 = 44$$

$$C = 170 \text{ V/mm.}$$

What is claimed as new and desired to be secured by Letters Patent of the United States is:

1. A method of producing a ceramic electrical resistor, having a nonlinear voltage-dependent current-voltage characteristic, and having a composition consisting essentially of 50–99 mol% zinc oxide, 0.05 to 10 mol% of at least one oxide of boron, and from 0.01 to 5 mol % of at least one oxide selected from the group consisting of the oxides of cobalt, manganese, chromium, antimony, silicon, and mixtures thereof, and wherein said composition contains essentially no bismuth oxide; which comprises the steps: mixing the starting materials in powder form and with grain size of from 0.1 to 1$\mu$; drying; sifting; calcining at around 450° C. for from 1 to 3 hours; pressing; and sintering the resulting briquette in air at from 1100° to 1350° C. for about 1 hour.

2. The method of claim 1, wherein said pressing is carried out at a pressure of from 300 to 500 kg/cm$^2$.

3. The method of claim 1, wherein said temperature is from 1200° to 1250° C.

4. The method of claim 1, wherein said sintered briquette is provided with metal contacts on its flat faces.

5. The method of claim 4, wherein said contacts are produced by baking, vapor deposition, sputtering, or metal spraying.

6. The method of claim 1, which further comprises annealing said sintered briquette for 15 hours at a temperature of from 600° to 1,000° C. under a pressure of 760 torr. in an oxygen atmosphere.

7. The method of claim 6, wherein said temperature is from 800° to 850° C.

* * * * *